US005862917A

United States Patent [19]

Noble et al.

[11] Patent Number: 5,862,917

[45] Date of Patent: Jan. 26, 1999

[54] PALLET SLEEVE CLIP WITH VISIBLE POSITIVE OPEN AND CLOSED POSITIONS

[75] Inventors: Jamie E. Noble, De Forest; Henry F. Brown, Portage; Dennis A. Giannini, Montello, all of Wis.

[73] Assignee: TriEnda Corporation, Portage, Wis.

[21] Appl. No.: 940,842

[22] Filed: Sep. 30, 1997

[51] Int. Cl.[6] ..... B65D 19/18

[52] U.S. Cl. ..... 206/600; 24/458; 24/543; 220/4.33

[58] Field of Search ..... 206/386, 595–600; 220/4.01, 4.21, 4.22, 4.24, 4.28, 4.29, 4.33; 24/287, 457, 458, 519, 543, 590, 464; 292/80, 83

[56] References Cited

U.S. PATENT DOCUMENTS

| | | | |
|---|---|---|---|
| 2,784,756 | 3/1957 | Resnick . | |
| 3,140,671 | 7/1964 | Kozak et al. . | |
| 3,404,444 | 10/1968 | Isbrandtsen . | |
| 3,752,511 | 8/1973 | Racy | 24/287 |
| 3,776,169 | 12/1973 | Strecker . | |
| 3,917,102 | 11/1975 | Repetti . | |
| 4,129,395 | 12/1978 | Theurer et al. . | |
| 4,239,149 | 12/1980 | Kupersmit . | |
| 4,426,015 | 1/1984 | Preston et al. . | |
| 4,741,449 | 5/1988 | Bersani . | |
| 4,936,451 | 6/1990 | Shuert . | |
| 4,989,731 | 2/1991 | Shuert . | |
| 5,109,985 | 5/1992 | Rose . | |
| 5,123,541 | 6/1992 | Giannini et al. | 206/600 |
| 5,133,460 | 7/1992 | Shuert . | |
| 5,231,246 | 7/1993 | Benson et al. | 24/458 |
| 5,261,550 | 11/1993 | Karpisek . | |
| 5,279,423 | 1/1994 | Shuert . | |
| 5,313,721 | 5/1994 | Filden | 24/458 |
| 5,358,137 | 10/1994 | Shuert et al. . | |
| 5,381,915 | 1/1995 | Yardley . | |
| 5,452,554 | 9/1995 | Santana . | |
| 5,651,463 | 7/1997 | Major et al. | 206/600 |
| 5,653,003 | 8/1997 | Freeman | 24/453 |
| 5,722,328 | 3/1998 | Darby | 206/600 |

*Primary Examiner*—Paul T. Sewell
*Assistant Examiner*—Luan K. Bui
*Attorney, Agent, or Firm*—Lathrop & Clark LLP

[57] ABSTRACT

A clip is disclosed for connecting adjacent portions of palletized shipping container, the clip including a foldable base for at least partially surrounding a first portion of the shipping container and a key rotatable relative to the foldable base for insertion into and through a slot in a second portion of the shipping container so that the key can be rotated to releasably join the first and second shipping container portions.

33 Claims, 5 Drawing Sheets

PALLET SLEEVE CLIP WITH VISIBLE POSITIVE OPEN AND CLOSED POSITIONS

FIELD OF THE INVENTION

The present invention relates to clips for modular palletized shipping containers used to SHIP and handle cargo. In particular, the invention relates to a shipping container clip that may be used to easily assemble and disassemble portions of a shipping container, and having a foldable connector for being joined to a first component of the container and a rotatable key that is inserted through a slot in a second component of the container to provide positive and readily visible engagement of two pallet components. The invention also relates to a modular shipping container assembled with the improved clips.

BACKGROUND OF THE INVENTION

Modular palletized shipping containers are assembled from a base or "pallet," a sidewall or "sleeve," and a cover or "top pallet." The components are preferably made of plastic that is shaped to be rigid, stackable, and enable easy handling by forklifts and personnel. These shipping containers permit compact storage of goods for transport and they facilitate easy loading and unloading of shipping vehicles. The shipping container components are designed for easy assembly and disassembly using removable connectors or clips.

U.S. Pat. No. 5,123,541 discloses modular palletized containers that include a base pallet, side walls (or sleeve), and a top pallet to form a strong container suited for transporting cargo. The connector disclosed in the '541 patent is suited to minimize the labor necessary to assemble or disassemble the container because it has a U-shaped connector portion for attachment to a sleeve and it has an integrally molded snapping clip that can quickly engage a slot on a container pallet. A sleeve connector that is molded in a U-shape is strong and relatively rigid, but it may complicate assembly when hand room is minimal. The use of snaps makes assembly quick, but disassembly may be more difficult when numerous clips are used along one edge of a container sleeve because after a first snap has been disengaged and another is in the process being disengaged, the first snap can become inadvertently re-engaged. Further, during assembly, it may be difficult to determine whether all of the snaps in a row have become fully engaged because one or more of the snap elements may be in the appropriate slot, but not in an engaged position. This can result in a substandard assembly situation in which the container can become unstable and unable to retain stored cargo.

Thus, it is desirable to have a modular palletized container clip with a positive locking action to ensure complete assembly of the container components, provide a connector portion that is visible in a locked position, and eliminate the possibility of inadvertent re-engagement of the clips when the container is being disassembled.

SUMMARY OF THE INVENTION

The present invention overcomes the deficiencies in the prior art by providing a pallet sleeve clip with positive open position, having a connector base that partially surrounds and is connected to a first container portion, and a key that is insertable into an opening of adjacent second container portion, the key for being rotated to resist being withdrawn from the second container portion opening. The key has an elongated handle that is visible in a locked position.

Preferably, the clip's base is foldable for ease of assembly, disassembly, and manufacturing.

Because the clip can be subjected to heavy loads, the key preferably includes a load bearing flange that engages a rib in the base to transfer load from the key to the base and vice versa. Also preferably, the key includes a cam flange for engagement with a first wall and/or a second wall to resist free-rotation of the key relative to the connector base while providing adequate resiliency and a low-friction surface to permit rotation of the key without special tools.

With the foregoing in mind, it is an advantage of the present invention to provide a shipping container clip with a positive open and closed positions.

Another advantage of this invention is to provide a clip with readily available visual verification means to ensure assembly of the container components.

A further advantage of this invention is to provide a clip that cannot become inadvertently re-engaged to a container component while the container is being disassembled.

Yet another advantage of the present invention is to provide a clip that is compact, lightweight, inexpensive, and simple to use.

It is also an advantage of this invention to provide a modular shipping container having a first container portion for being joined to a second container portion using a clip with visible positive open and closed positions as described above.

Further advantages, features, and objects of the invention will be apparent from the following detailed description when taken in conjunction with the accompanying drawings.

DETAILED DESCRIPTION OF THE DRAWINGS

Figure 1:
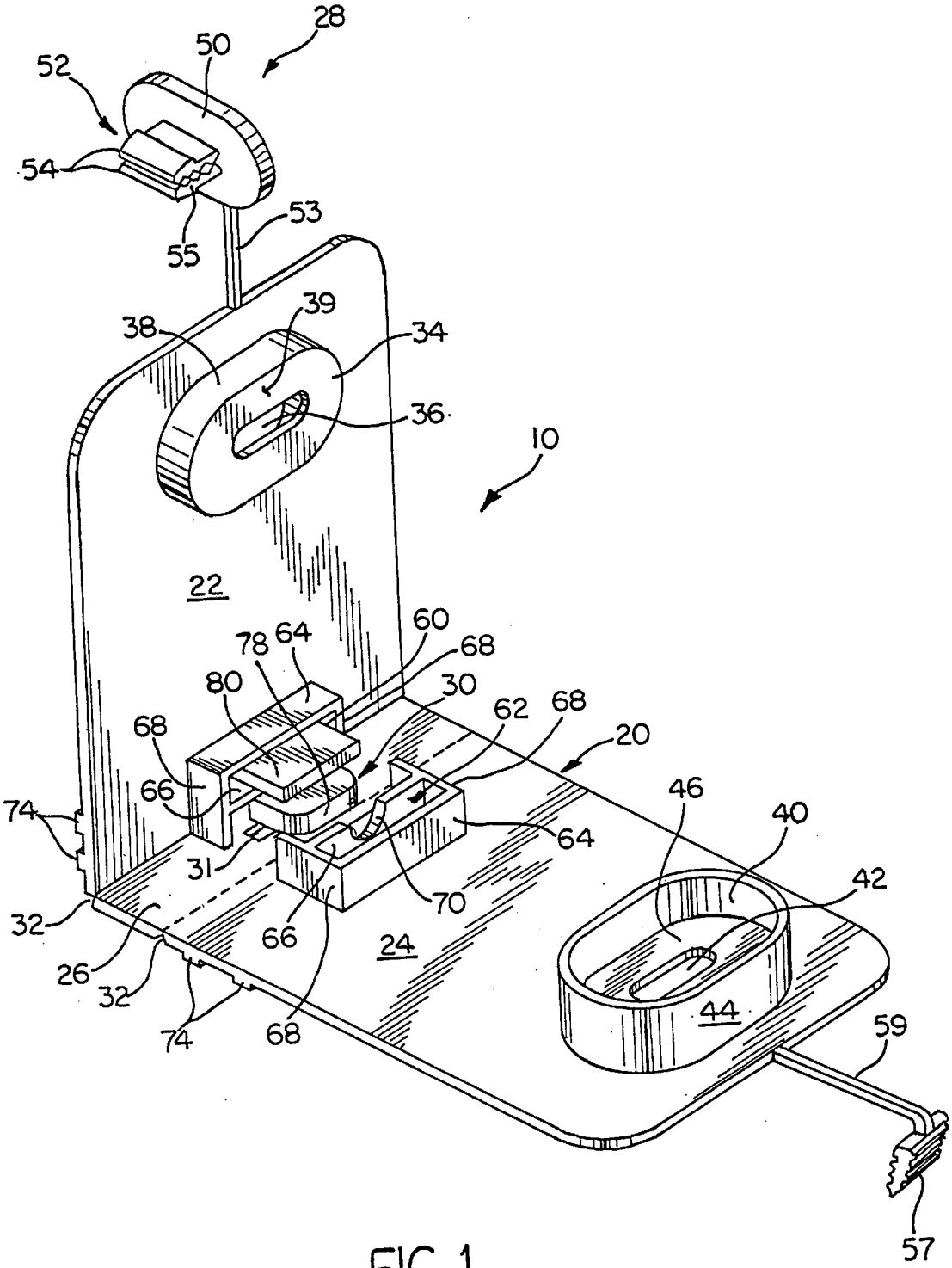
FIG. 1 is a perspective view of a partially folded container clip in accordance with present invention.
Figures 2, 3:
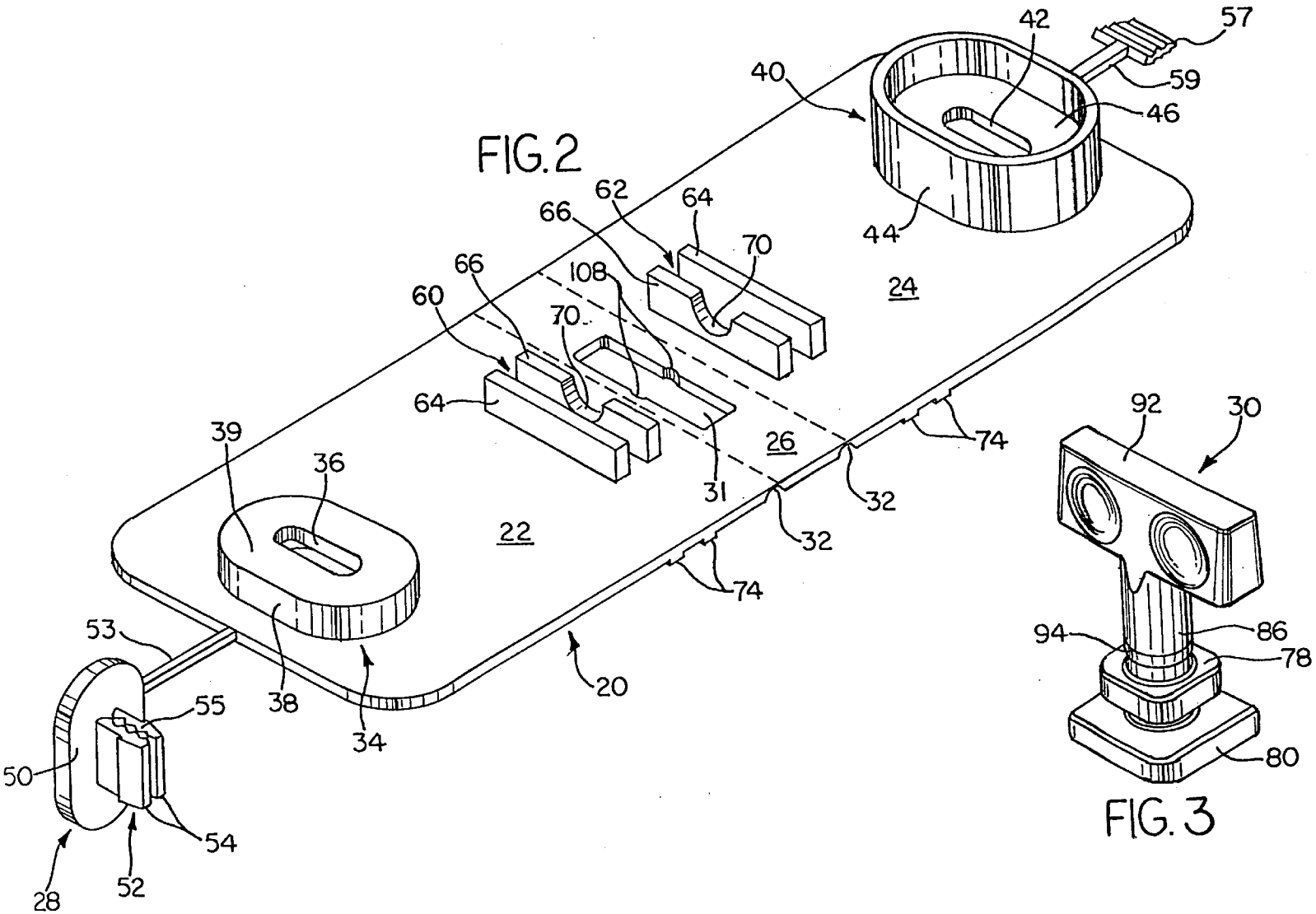
FIG. 2 is a perspective view of a clip base in an unfolded position.
FIG. 3 is a perspective view of a key in accordance with the present invention.

Referring to FIGS. 1 to 3, there is a pallet sleeve clip with positive open position 10, in accordance with the present invention which includes a foldable base 20, a first wall 22, a second wall 24, and a central portion 26. A male snap element 28 is joined to the base 20 and a key 30 is rotatably disposed in a slot 31 of the base central portion 26. The base 20 preferably is made of plastic, and the first wall 22, second wall 24 and the central portion 26, and the male snap element 28 are all preferably integrally molded. The first wall 22 and the second wall 24 are hinged to the central portion 26 at lines of reduced base thickness to form living hinges 32, although other types of hinges or flexible base material can be used in accordance with the present invention.

Molded integrally with the first wall 22 is a male spacer 34 depicted in a generally oval shape with a radiused slot 36 therein. The male spacer 34 includes an annular wall 38 and a flat face 39. Molded integrally with the second wall 24 is a female spacer 40 of a generally oval shape having a radiused slot 42 therein. The female spacer 40 includes an annular wall 44 and a flat floor plate 46 that is molded in the annular wall 44 in a plane spaced apart from a plane defined by the second wall 24. The female spacer 40 is adapted to receive the male spacer 34 in a relatively close fit with the annular wall 38 of the male spacer 34 positioned closely to the annular wall 44 of the female spacer 40, and the flat face 39 of the male spacer 34 is in a bearing relationship with the floor plate 46 of the female spacer 40. When the male spacer 34 is received within the female spacer 40, the male spacer slot 36 is substantially aligned with the female spacer slot 42. Although the slots 36 and 42 are depicted as radiused slots, other opening shapes can be used.

Further, when the male spacer 34 is received within the female spacer 40, they are in a position to be releasably engaged by the male snap element 28. The male snap element 28 includes a plate 50, a bifurcated snap 52, and an integral lanyard 53 joining the back of the plate 50 to the edge of the first wall 22. The bifurcated snap 52 includes spaced apart elongated ridged elements 54 that together extend through the slots 36 and 42 and snap into engagement with a back side of the floor plate 46 of the female spacer 40. With this arrangement of the elongated ridged elements 54, the male snap element 28 is rigid enough to securely connect the male spacer 34 and the female spacer 40, but resilient enough to be detached when desired. If a more secure connection is desired, the ridged elements 54 can include opposing transverse ratchet ribs 55 on their interior surfaces to receive a ratchet wedge 57. The ratchet wedge 57 is joined to the second wall 24 with an integrally molded lanyard 59 and is shaped to be inserted into the bifurcated snap 52 and urge the ridged elements 54 outward to prevent the snap from being inadvertently disengaged. The ratchet wedge 57 is ribbed to ratchetly engage the ribs 55 on the ridged elements 54 to prevent the wedge 57 from pulling out. Although the depicted design of the male snap element 28 is preferred, other fasteners of various designs, shapes, and sizes are within the scope of the invention.

As stated above, the female spacer floor plate 46 is in a plane spaced from the plane of the second wall 24 and the flat face 39 of the male spacer is spaced from the plane of the first wall 22. In this manner, the male and female spacers 34 and 40 are at the bottoms of recesses in the base 20 into which the bifurcated snap 52 sits when engaged to the clip 10 so that there are no protuberances to snag on equipment or personnel.

Also molded integrally with the first wall 22 and the second wall 24, are load bearing notches 60 and 62, respectively. Each load bearing notch includes a top load bearing rib 64 and a bottom load bearing rib 66 that are optionally reinforced with transversely extending ends 68 (not illustrated in FIG. 2). The top rib 64 is illustrated as having a uniform cross-section along its length and the bottom rib 66 includes a semi-circular opening 70 to receive the key 30 as described in detail below. Each of the load bearing notches 60 and 62, are depicted as being open through the first wall 22 and second wall 24, respectively, for ease of manufacture, however it is not necessary for the notches to extend through the first wall 22 and the second wall 24. Further, it is preferable that the load bearing notches 60 and 62 be reinforced with a pair of protruding back ribs 74. The transverse ribs 68 also preferably include opposing alignment shelves (not illustrated) that engage one another when the base 20 is folded so that the load bearing notches 60 and 62 are ensured to be aligned for full load transfer. Various other types of alignment devices such as male/female couplings may also be used.

Figure 4:
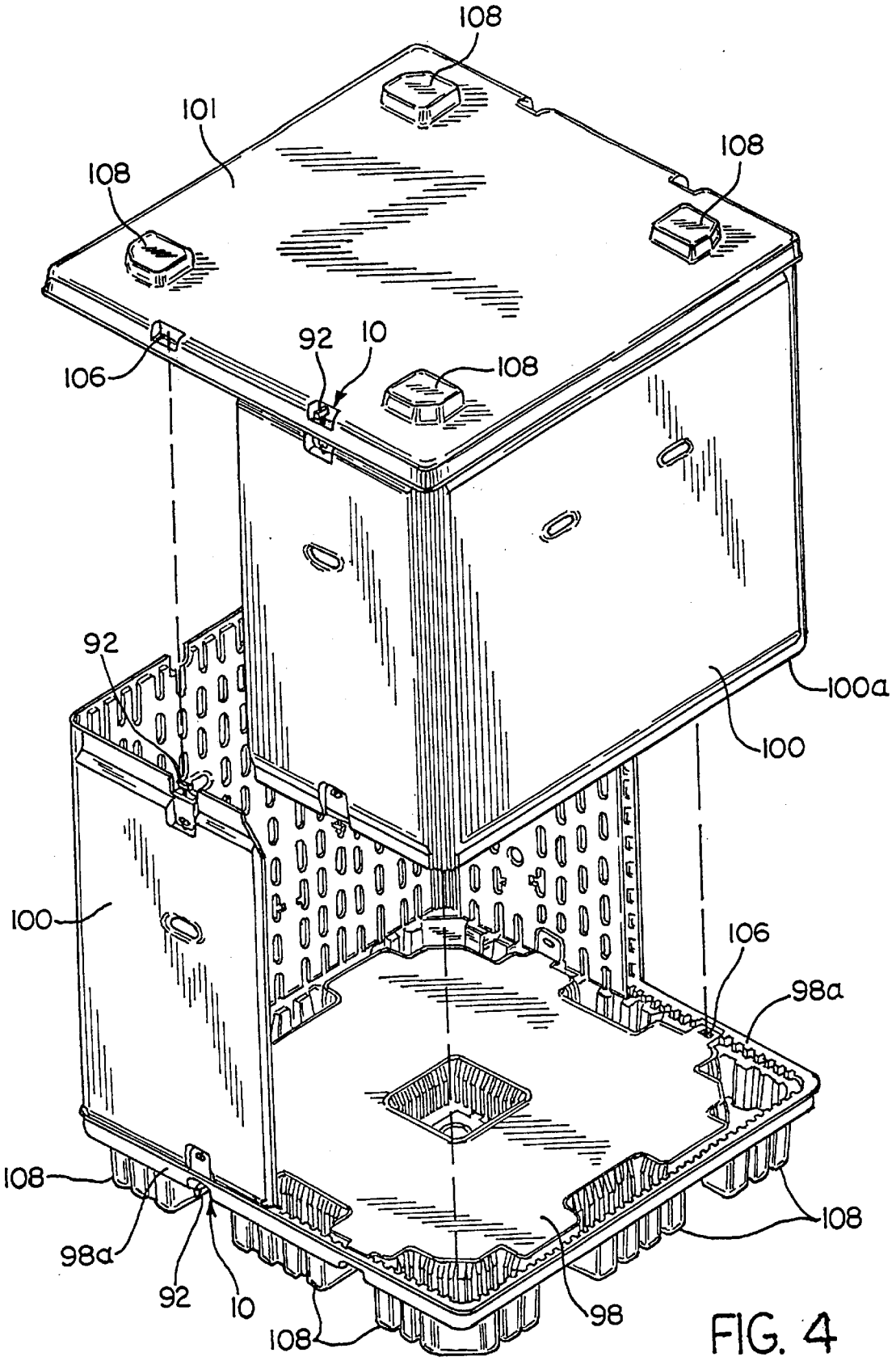
FIG. 4 is a partially exploded perspective view of a palletized shipping container and container clip in accordance with present invention.
Figure 6:
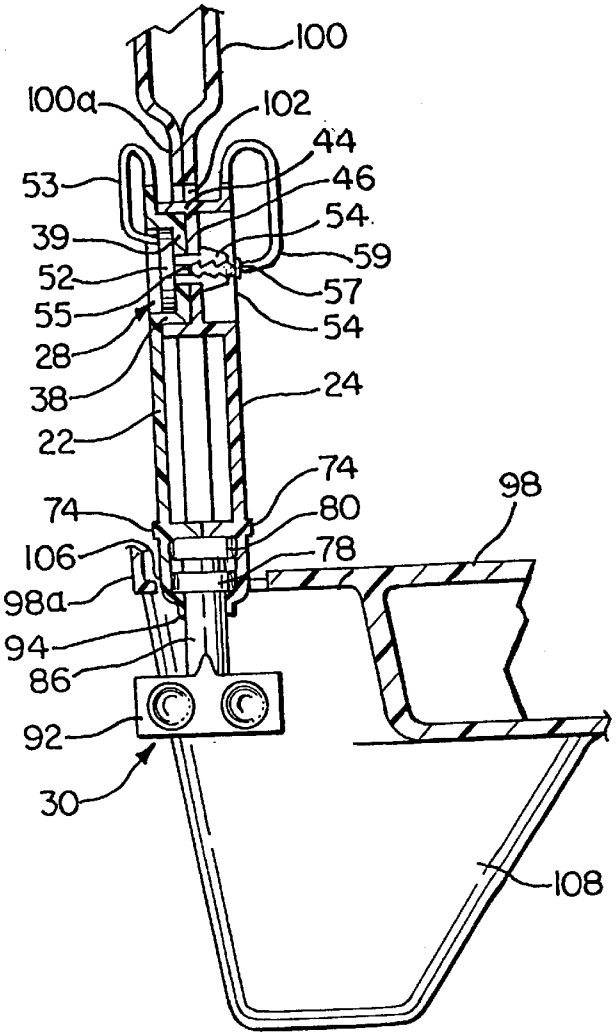
FIG. 6 is a partial cross-sectional view of the clip and container portions taken along line 6—6 in FIG. 5.
Figure 5:
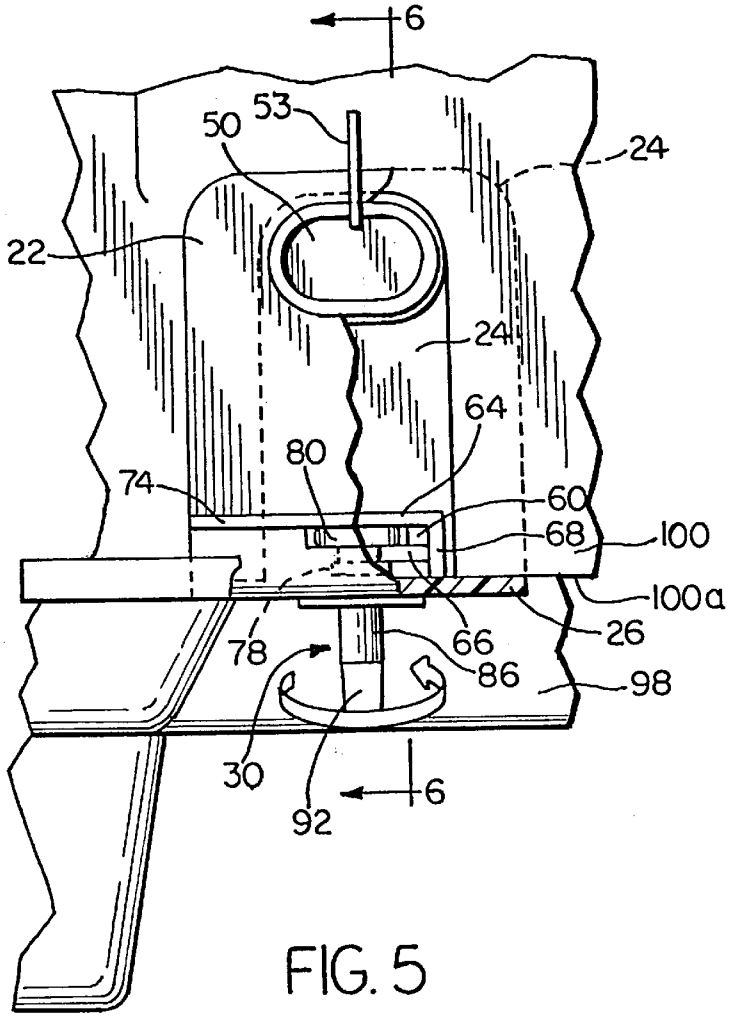
FIG. 5 is a partial cross-sectional view of a clip in accordance with present invention joining fragmented first and second portions of a shipping container.

As illustrated in FIGS. 4 to 6, the base 20 and the male snap element 28 form a sleeve connector which can be attached to the sleeve 100 by folding the first wall 22 and the second wall 24 about the central portion 26 into a U-shape to partially surround a portion of the sleeve 100. The female spacer 40 can then be inserted into a sleeve hole 102 (FIG. 6) that is positioned to substantially align with the male spacer slot 36 and the female spacer slot 42. So arranged, the male snap element 28 can be inserted through the male spacer slot 36, the female spacer slot 42, and the sleeve hole 102 to secure the clip 10 to the sleeve 100. The spacers 34 and 40, slots 36 and 42, and the sleeve hole 100 can be of any shape, and be formed in or cut from their respective components. In this position, the clip 10 is ready to be secured to a pallet 98 with the key 30. It is to be understood that the term "pallet" as used herein includes pallets and covers for bulk containers. The cover may be a pallet or other suitable structure and be within the scope of this invention.

The key 30 as illustrated in FIGS. 1 and 3 to 6, includes a cam flange 78 and a load bearing flange 80. The cam flange 78 has slightly radiused corners 82 and will be sandwiched between the first wall 22 and the second wall 24 when the base 20 is folded into a U-shape so that the rounded corners of the cam flange 78 will resist rotation of the key 30 relative to the base 20, but due to the resiliency of the base 20 and low coefficient of friction between the base 20 and the cam flange 78, the key 30 can be rotated by hand when desired.

The load bearing flange 80 is depicted as being substantially square in shape and is adapted to be received into the load bearing notches 60 and 62 between the top and bottom ribs 64 and 66. Although depicted as square, the load bearing flange 80 can have rounded corners and bear on base surfaces (not illustrated) to serve the same function as the cam flange 78. This arrangement of the load bearing flange 80 in the load bearing notches 60 and 62 permits the translation of a load from the key 30 to the base 20, and vice versa. The top rib 64 engages the load bearing flange 80 when the clip 10 is under compression and the bottom rib 66 engages the load bearing flange when the clip 10 is under tension.

Illustrated in FIGS. 3, 5, and 6, an elongated stem 86 extends between the cam flange 78 and the load bearing flange 80. The elongated stem 86 is received into the semi-circular openings 70 in the bottom ribs 66 when the base 20 is folded into a U-shape. The elongated stem 86 extends farther downward below the cam flange 78 and out of a central portion slot 90 that may have a pair of opposing detents 108 (FIG. 2) to keep the key 30 centered.

As illustrated FIGS. 3, 4, 5, and 6, there is an elongated handle 92 fixed to the opposite end of the elongated stem 86 and extending transversely to the longitudinal axis of the elongated stem 86. Preferably, the elongated handle 92 includes a pair of detents on each side to provide a better grip surface to rotate the key 30 by hand when desired. The key 30 also preferably includes an annular rib 94 that bears on the back side of the central portion 26 to keep the elongated handle 92 spaced away from the central portion 26 of the base 20.

Shown in FIG. 4, there is a shipping container 96 including a base pallet 98, a sidewall structure (or sleeve) 100, and a top pallet 101. The base pallet 98 and top pallet 101 may be interchangeable. The base pallet 98, the sleeve 100, and the top pallet 101 are removably interconnected by one or more of the clips 10, which are affixed to the sleeve 100 and which engage the pallets 98 and 101 at points along their periphery.

The sleeve 100 is preferably made of corrugated plastic or cardboard which has folds formed at its corners and at mid-points of opposing sleeves so that the sleeve 100 can be collapsed into a substantially flat or compact shape. Other sleeve shapes and materials, as well as, sleeves made from various manufacturing methods can be used with the present invention. Preferably, locations where the clips 10 are to be attached to the sleeve 100 are flattened to a thin cross-section and include a hole 102 in which the female spacer 40 is received. The flattened cross-section permits the clip 10 to lie flush with or interior to the outer surface of the sleeve 100. Once the base 20 is folded into a U-shape around the flattened portion of the sleeve 100 so that the male spacer 34 is positioned in the female spacer 40 and the female space or 40 is positioned in the hole 102, the male snap element 28 can be inserted into the slots 36 and 42 to secure the base 20 to the sleeve 100.

The base pallet 98 and top pallet 101 are made of plastic and have a number of projections (or feet)108 which support the container 96 above a floor and can provide space above and below the container 96 to permit handling by a forklift. The projections 108 also permit multiple stacking of containers 96 by engaging the pallet projections 108 on another container's projections placed immediately above or below the container illustrated.

As illustrated in FIGS. 4 to 6, the sleeve 100 and the base pallet 98 can be assembled by wrapping a portion of the sleeve 100 with a clip base 20 and securing clip base to the sleeve 100 with the male snap element 28. Then a lower edge 100*a* of the sleeve 100 is inserted into a raised lip 98*a* of the base pallet 98. The keys 30 of the clips 10 are simultaneously inserted into receiving slots 106 of the base pallet 98, as shown FIG. 5. With the key 30 positioned in a receiving slot 106, the key 30 is grasped by the elongated handle 92 and rotated about 90 degrees so that the elongated handle 92 is no longer aligned with the receiving slot 106 to prevent the key 30 from being withdrawn through the slot 106. Once turned, the elongated handle 92 (such as the handle on the clip in the lower left of FIG. 5) is visible from under the raised lip 98*a* so that there is visible confirmation that the connection has been made. Likewise, during disassembly the handle 92 will not be visible or it will be clearly seen to be in an unlocked position, and it will not be able to inadvertently reconnect to the pallet 98 while other disassembly operations are being performed.

Due to the length of the key stem 86, the elongated handle 92 will be positioned slightly away from the pallet slot 106 to permit easy handling while being turned at least a portion of a turn so that the handle 92 can not be withdrawn from the pallet slot 106. With the base 20 secured to the sleeve 100 and the key 30 secured to a pallet 98, the sleeve 100 and the pallet 98 will be releasably secured to one another to form at least a portion of a bulk shipping container. It is preferred that two clips 10 be used on each side of a pallet or sleeve, but any number can be used depending upon loading and conditions. Further, it is only necessary that the clip 10 connect two parts of a bulk shipping container and it may be that the clip 10 will connect two sleeves or sleeve portions, or one pallet to an adjacent pallet, or a pallet to a cover when shipping containers are stacked. However, in the described embodiment, the use of a foldable base 20 surrounding at least portion of the sleeve 100 provides a degree of stability between the clip 10 and sleeve 100 for a sturdy connection.

Figure 7:
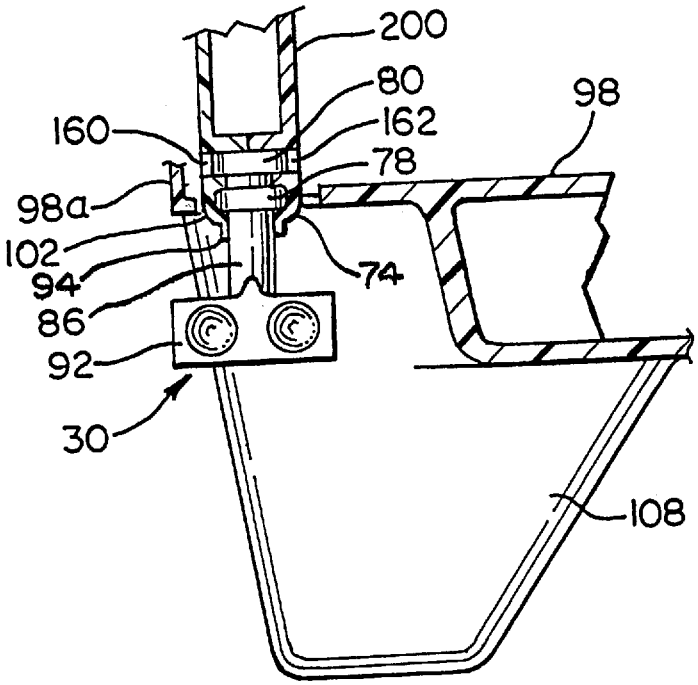
FIG. 7 is a partial cross-sectional view of a container sleeve with integral load bearing ribs and a rotatable key therein.

FIG. 7 illustrates an alternative embodiment of the invention which is similar to the embodiment described above insofar as the key 30 is concerned. The difference lies in the absence of a sleeve connector portion of the clip 10 which is replaced with a pair of load bearing notches 160 and 162 fixed to internal surfaces of the sleeve 200 or other shipping container component. In this embodiment, the key 30 is retained within the sleeve 200 during the sleeve-forming or manufacturing process. The key 30 can be rotated as described above and there is no need for a sleeve connector to be attached in a separate operation. In this manner, the sleeve 200 is attached to the pallet 98 by simply lowering the sleeve 200 to insert the key handle 92 into pallet hole 102 and rotating the key 30.

It is understood that the invention is not limited to the particular construction and arrangement of parts herein illustrated and described, but embraces such modified forms thereof as come within the scope of the following claims.

We claim:

1. A clip for joining a first component to a second component of a palletized shipping container, the second component having an opening formed therein, the clip comprising:

a first component connector engaging the first component; and a key rotatably engaged to the first component connector and having an elongated handle for extending through the second component opening and being rotated at least a portion of a turn to prevent withdrawal from the opening and thereby prevent separation of the first component from the second component.

2. The clip of claim 1, wherein the first component connector comprises:

a foldable base for being folded at least partially around the first component and defining mating openings for alignment with a first component opening; and a fastener for engagement with the openings of the foldable base and the first component.

3. The clip of claim 1, wherein the first component connector comprises:

a central portion for rotatably engaging the key;

a first wall joined to the central portion and having a male spacer with an opening therein;

a second wall joined to the central portion and having a female spacer with an opening therein, the female spacer adapted to receive the male spacer, and the female spacer being adapted for insertion into a first component opening; and a fastener adapted to engage the first wall male spacer, the second wall female spacer, and the first component through their respective openings.

4. The clip of claim 3, wherein the fastener includes a male snap element.

5. The clip of claim 3, wherein the fastener includes:

a male snap element having ratchet ribs: and a ratchet wedge for engaging the ratchet ribs on the male snap element and resisting disengagement of the fastener from the spacers.

6. The clip of claim 3, wherein the first wall and the second wall are joined to the central portion with hinges.

7. The clip of claim 1, wherein the key comprises:

an elongated stem rotatably disposed in a hole in the first component connector and fixed to the elongated head; and a cam flange fixed to the stem and adapted to engage the connector and resist rotation of the key relative to the connector.

8. The clip of claim 1, wherein the key comprises:

an elongated stem fixed to the elongated head and rotatably disposed in a hole in the first component connector;

a cam flange fixed to the stem, and adapted to engage the first component connector and resist rotation of the key relative to the connector; and a load bearing flange fixed to the elongated stem and in bearing contact with a rib fixed to the connector.

9. The clip of claim 1, wherein the key comprises:

an elongated stem fixed to the elongated head and rotatably disposed in a hole in the first component connector; and a load bearing flange fixed to the elongated stem and in bearing contact with a rib fixed to the first component connector.

10. The clip of claim 1, wherein the first component connector comprises:

a central portion for rotatably engaging the key;

a first wall joined to the central portion and having a male spacer with an opening therein;

a second wall joined to the central portion and having a female spacer with an opening therein, the female spacer adapted to receive the male spacer and the female spacer being adapted for insertion into a first component opening; and a fastener adapted to engage the first wall male spacer, the second wall female spacer, and the first component through their respective openings; and wherein the key comprises:

an elongated stem fixed to the elongated handle and rotatably disposed in a hole in the central portion of the connector;

a cam flange fixed to the stem and adapted to engage the connector and thereby resist rotation of the key relative to the first component connector; and a load bearing flange fixed to the elongated stem, the load bearing flange adapted to bear on a rib fixed to the first component connector.

11. A clip for joining a first component to a second component of a modular shipping container, the first and second components each having an opening therein, the clip comprising:

a foldable connector having a central portion defining a hole, a first wall joined to the central portion and having a male spacer with an opening therein, a second wall joined to the central portion and having a female spacer with an opening therein, the female spacer adapted to receive the male spacer, and the female spacer being adapted for insertion into the first component opening, and a fastener element adapted to engage the first wall male spacer, the second wall female spacer, and the first component through their respective openings; and a key having an elongated stem rotatably disposed in the first connector central portion hole, an elongated handle fixed to the elongated stem and adapted to extend through the second component opening for rotation relative thereto to prevent withdrawal of the key handle through the second component opening, and a load bearing flange fixed to the elongated stem and adapted to bear on a rib fixed to the first component connector.

12. The clip of claim 11, wherein the load bearing flange of the key is adapted to bear on a pair of opposing load bearing ribs, one each formed in the first wall and the second wall of the first component connector.

13. The clip of claim 11, wherein the load bearing flange of the key is disposed between two pairs of opposing load bearing ribs, one pair each formed in the first wall and the second wall of the first component connector.

14. The clip of claim 11, wherein the fastener includes a male snap element.

15. The clip of claim 11, wherein the fastener includes:

a male snap element having ratchet ribs: and a ratchet wedge for ratchetly engaging the ratchet ribs and resisting disengagement of the fastener from the spacers.

16. The clip of claim 11, wherein the key further comprises a cam flange fixed to the stem and adapted to engage the first component connector and resist rotation of the key relative to the first component connector.

17. The clip of claim 11, wherein the first component connector male snap element is bifurcated for enhanced resiliency.

18. A shipping container comprising:

a first component;

a second component having an opening formed therein and for being releasably secured to the first component; and a clip having a first component wherein the first component connector comprises a U-shaped base for at least partially surrounding the first component and defining mating snap openings for alignment with a first component opening, and a male snap element for engagement with the openings of the U-shaped base and the first component, connector engaging the first component, and a key rotatably engaged to the first component connector and having an elongated handle for extending through the second component opening, the key for being rotated at least a portion of a turn to prevent withdrawal from the opening and thereby prevent separation of the first component from the second component.

19. The shipping container of claim 18, wherein the first component connector comprises:

a foldable base for being folded at least partially around the first component and defining mating snap openings for alignment with a first component opening; and a male snap element for engagement with the openings of the foldable base and the first component.

20. The shipping container of claim 18, wherein the first component connector comprises:

a central portion for rotatably engaging the key;

a first wall joined to the central portion and having a male spacer with an opening therein;

a second wall joined to the central portion and having a female spacer with an opening therein, the female spacer adapted to receive the male spacer, and the female spacer being adapted for insertion into a first component opening; and a fastener adapted to releasably engage the first wall male spacer, the second wall female spacer, and the first component through their respective openings.

21. The shipping container of claim 20, wherein the first wall and the second wall are joined to the central portion with hinges.

22. The shipping container of claim 20, wherein the fastener includes a male snap element.

23. The shipping container of claim 20, wherein the fastener includes:

a male snap element having ratchet ribs;

a ratchet wedge for ratchetly engaging the ratchet ribs and resisting disengagement of the fastener from the spacers.

24. The shipping container of claim 18, wherein the key comprises:

an elongated stem fixed to the elongated handle and rotatably disposed in a hole in the first component connector; and a cam flange fixed to the stem and adapted to engage the first component connector and resist rotation of the key relative to the connector.

25. The shipping container of claim 18, wherein the key comprises:

an elongated stem fixed to the elongated head and rotatably disposed in a hole in the connector;

a cam flange fixed to the stem and adapted to engage the first component connector and resist rotation of the key relative to the connector; and a load bearing flange fixed to the elongated stem and in bearing contact with a rib fixed to the first component connector.

26. The shipping container of claim 18, wherein the key comprises:

an elongated stem fixed to the elongated head and rotatably disposed in a hole in the first component connector; and a load bearing flange fixed to the elongated stem and in bearing contact with a rib fixed to the first component connector.

27. The shipping container of claim 18, wherein the first component connector comprises:

a central portion for rotatably engaging the key;

a first wall joined to the central portion and having a male spacer with an opening therein;

a second wall joined to the central portion and having a female spacer with an opening therein, the female spacer adapted to receive the male spacer and the female spacer being adapted for insertion into a first component opening; and a fastener adapted to releasably engage the first wall male spacer, the second wall female spacer, and the first component through their respective openings; and wherein the key comprises:

an elongated stem fixed to the elongated head and rotatably disposed in a hole in the central portion of the first component connector;

a cam flange fixed to the stem and adapted to engage the connector and thereby resist rotation of the key relative to the first component connector; and a load bearing flange fixed to the elongated stem, the load bearing flange adapted to bear on a rib fixed to the first component connector.

28. The shipping container of claim 18, wherein the first container component is a sleeve.

29. The shipping container of claim 18, wherein the second container component is a pallet.

30. A clip for releasably connecting a sleeve with a through hole to a pallet having a slot therein, the clip comprising:

a first wall which extends along the sleeve;

a second wall which is spaced from the first wall and which extends generally parallel to the first wall, wherein the first wall is releasably fastened to the second wall through the sleeve;

a central portion which is hingedly connected between the first wall and the second wall, the central portion defining an opening therein;

a key having a stem which extends through the central portion opening, wherein a flange extends from the stem between the first wall and the second wall, to retain the key between the first wall and the second wall; and an elongated handle extending outwardly from the stem beneath the central portion, such that the central portion is positioned between the handle and the key flange, the handle being narrower in a first dimension than in a second dimension, such that the handle passes through the pallet slot when disposed in a first orientation, but does not pass through the pallet slow when disposed in a second orientation.

31. The clip of claim 30 further comprising:

a top rib extending from at least one of the first wall and the second wall;

a bottom rib extending from at least one of the first wall and the second wall, such that the key flange is captured between the top rib and the bottom rib.

32. The clip of claim 30, wherein the top rib comprises portions which extend from the first wall and portions which extend from the second wall and wherein the bottom rib comprises portions which extend from the first wall and the second wall, each bottom rib portion defining a recess through which the key stem extends.

33. The clip of claim 30 wherein the key flange is nonround, and wherein the key stem is rotatable between a positive open position, and an intermediate position in which the flange engages the first wall and the second wall and thereby displaces portions of the first wall and the second wall with respect to one another.

* * * * *

UNITED STATES PATENT AND TRADEMARK OFFICE

CERTIFICATE OF CORRECTION

PATENT NO. : 5,862,917
DATED : January 26, 1999
INVENTOR(S) : Noble et al.

It is certified that error appears in the above-identified patent and that said Letters Patent is hereby corrected as shown below:

In column 6, lines 26 - 27 (Claim 1), change "a first component connector engaging the first component; and" to – a first component connector engaging the first component, wherein the first component connector comprises a U-shaped base for at least partially surrounding the first component and defining mating openings for alignment with a first component opening, and a fastener for engagement with the openings of the U-shaped base and the first component; and –.

Signed and Sealed this

Twenty-eighth Day of September, 1999

*Attest:*

Q. TODD DICKINSON

*Attesting Officer*

*Acting Commissioner of Patents and Trademarks*